US006672600B2

(12) United States Patent
Engelhardt et al.

(10) Patent No.: US 6,672,600 B2
(45) Date of Patent: Jan. 6, 2004

(54) GOLF BAG

(76) Inventors: Barbara Engelhardt, August-Lämmle-Weg 9, D-73344 Gruibingen (DE); Michael Engelhardt, August-Lämmle-Weg 9, D-73344 Gruibingen (DE)

( * ) Notice: Subject to any disclaimer, the term of this patent is extended or adjusted under 35 U.S.C. 154(b) by 115 days.

(21) Appl. No.: 09/950,594

(22) Filed: Sep. 12, 2001

(65) Prior Publication Data

US 2002/0033583 A1 Mar. 21, 2002

(30) Foreign Application Priority Data

Sep. 17, 2000 (DE) ..... 200 17 948 U
Jul. 31, 2001 (DE) ..... 101 37 185

(51) Int. Cl.[7] ..... B62B 1/10

(52) U.S. Cl. ..... 280/47.26; 280/DIG. 6; 280/47.131

(58) Field of Search ..... 280/30, 651, 652, 280/653, 654, 655, 659, 645, 43, 47.17, 43.1, 47.24, 47.25, 47.26, 47.28, 47.29, 47.31, 47.315, 47.33, 47.38, 47.131, 79.6, 79.7, DIG. 5, DIG. 6

(56) References Cited

U.S. PATENT DOCUMENTS 646,869 A * 4/1900 Perkes ..... 280/47.31
1,555,772 A * 9/1925 Stripe ..... 280/47.26
2,458,924 A * 1/1949 Baker ..... 280/655
2,559,951 A * 7/1951 Dunbar et al. ..... 280/659
2,572,408 A * 10/1951 Hoek ..... 280/645
2,602,676 A * 7/1952 Fieldhouse ..... 280/47.23
2,613,952 A * 10/1952 Lannon ..... 280/47.31
2,621,799 A * 12/1952 Wilson ..... 280/DIG. 6
2,629,609 A * 2/1953 Wilson ..... 280/655
2,698,040 A * 12/1954 Wilkens ..... 280/655
2,854,244 A * 9/1958 Jarman ..... 280/47.26
3,096,992 A * 7/1963 Fritsch ..... 280/47.31
3,471,162 A * 10/1969 Meiklejohn ..... 280/47.26
3,985,373 A * 10/1976 Widegren ..... 280/652
4,053,169 A * 10/1977 Taylor ..... 280/37
5,472,084 A * 12/1995 Aliano, Jr. ..... 206/315.3
5,605,310 A * 2/1997 Jungkind ..... 248/96
5,799,967 A * 9/1998 Lin ..... 280/646
5,868,247 A * 2/1999 Schrader ..... 280/47.24
6,068,271 A * 5/2000 Lustica ..... 280/47.26
6,231,059 B1 * 5/2001 Cheldin ..... 280/47.24
6,460,867 B2 * 10/2002 Sciulli ..... 280/47.26

* cited by examiner

*Primary Examiner*—Brian L. Johnson
*Assistant Examiner*—Hau Phan
(74) *Attorney, Agent, or Firm*—McGlew and Tuttle, P.C.

(57) ABSTRACT

A golf bag includes a bottom part, a cylinder part with stabilizing longitudinal webs, a head part, a support device with toggle lever mechanism or another mechanism and a clamping system for folding out and folding in support legs, a pull-out grip and a belt system. The golf bag combines in itself all components for stable standing, rolling, sloped support, carrying on the shoulder or on the back and for transport in the lying or upright position without additional actions on the part of the golfer. The golf bag is easy to handle and can be transported in a compact manner. The golf bag includes a cylinder part (2) provided with a belt system (8), which is connected in a repeatedly detachable manner to a rollable bottom part (1) tiltable in the direction of travel, on the one hand, and to a head part (4) equipped with a pull-out grip (7) and with a support device (5) by means of a plurality of stabilizing longitudinal webs (3) and (3'), wherein the properties of the golf bag are guaranteed by wheels (9) on the bottom part (1) and a support device (5) on the head part (4) and the lightweight design and ability to be disassembled.

15 Claims, 6 Drawing Sheets

Section A-A

Section B-B

GOLF BAG

FIELD OF THE INVENTION

The present invention pertains to a golf bag, comprising a bottom part, a cylinder part with stabilizing longitudinal webs, a head part, a support device with a toggle lever mechanism or another mechanism and a clamping system for folding out and folding in support legs and with a pull-out grip as well as with a belt system, which combines in itself all components for stable standing, for rolling, for sloped support for carrying on the shoulder or on the back and for transport in the lying or upright position without additional actions on the part of the golfer.

BACKGROUND OF THE INVENTION

Many different embodiments of golf bags with various advantages have been known. For example, golf bags have been known which are to be carried on the shoulder with a belt and tilt over easily or are labile on standing when put down on the ground. Attempts are made to overcome this shortcoming by means of stabilizing parts in the body of the golf bag, as a result of which the bags have a considerable weight.

A double belt system for golf bags, which makes it possible to pickup the golf bag like a backpack over the back, has also been known from EP 0461243 B1. However, the belt system is suitable only for carrying the golf bag and does not make it possible in itself either to roll the bag over the golf course or to put it down in a suitable position.

There are also golf bags that have a support device which is released by means of a lever mechanism at the head part. The support legs arranged outside on the golf bag must be folded out and folded in and transported on the shoulder each time there is a change in place. These golf bags cannot be rolled, either.

A support device has also been known from DE 43 27 289 C2 in which the support legs are folded in automatically by taking up the belts and they are folded out again on relieving the belts during a change in place. The folding in and out of the support legs is triggered in this support device by a folding mechanism arranged on the bottom part of the golf bag. When the golf bag is put down, the folding mechanism is pressed onto the bottom of the bag, as a result of which the support legs fold out. When the golf bag is picked up, the folding mechanism is released from the bottom and the support legs are again in contact with the golf bag. This technique is delicate and leads to increased weight of the golf bag due to the necessary structure. With both of these support devices, the golf bags must be carried on the shoulder, which may be difficult especially for elderly golfers.

To eliminate this problem, various chassis or carts have been developed, on which the golf bags can be transported. These off-road vehicles are heavy and bulky. For transportation in the automobile, they require complicated packaging operations and a considerable amount of space beside the golf bag, e.g., in the trunk of an automobile.

A golf bag with an off-road chassis integrated with the golf bag and with a pull-out grip has also been known from WO 97/29809. The design requires much time for assembly and taking apart, considerable skill and has a heavy weight, which is again problematic during loading and unloading in and from an automobile.

SUMMARY AND OBJECTS OF THE INVENTION

The object of the present invention is therefore to develop a golf bag which combines in itself all the properties for stable standing, rolling, sloped support, carrying on the shoulder or on the back and for transportation in the lying or upright position as needed without additional actions on the part of the golfer, is easy to handle, can be transported in a compact form and eliminates the above-described drawbacks of the state of the art.

According to the invention, a golf bag is provided with a cylinder part, which is in turn detachably connected to a rollable bottom part, on the one hand, and to a head part, on the other hand. This construction makes possible easy assembly and easy disassembly due to a screw connection. Due to the parts of the golf bag being screwed together, the golf bag becomes able to be repaired, which saves time in the case of the replacement of individual worn or defective parts of the golf bag and above all saves costs.

The dimensionally stable bottom part of the golf bag has off-road wheels and occasionally additionally a support foot, which guarantee the easy rolling of the golf bag in case of change of place and its putting down vertically in a stable manner entirely without additional actions together with the pull-out grip arranged at the head part of the golf bag. Furthermore, a support device arranged at the head part makes it possible to put down the golf bag in a sloped position, where the releasing of the support device by the belt system arranged on the cylinder part of the golf bag or by another release mechanism makes it possible to eliminate the need for additional actions for folding in the support legs. Thus, the golf bag according to the present invention makes it possible to put down the golf bag in a vertical position, to roll it in case of a change of place, to put it down in a sloped position, and to carry it on the shoulder or on the back or to transport it in a lying or upright position as needed, without the user having to perform any essential manual actions to release the individual components, which in turn guarantees the easy handling of the golf bag.

The bottom part of the golf bag according to the present may comprise a low-weight, wear-resistant and dimensionally stable one-piece container. This leads to a low weight of the golf bag despite all the techniques available in the area of golf bags and despite the versatile use of the golf bag. The shaping of the bottom part with a base designed in a stepped manner to the longitudinal axis of the golf bag and with wheel cases integrated into the jacket surface creates the conditions for the wheels being essentially covered and protected by the wheel cases and for the tiltability of the bottom part being guaranteed. Even though the wheels project beyond the jacket surface in the case of a jacket surface made in one piece cylindrically without wheel cases, the bottom part of the golf bag can thus be manufactured in an even more inexpensive design. The base of the bottom part may also be beveled in order to make it possible to arrange beside the wheels other support devices, even prior-art ones, with a tilting bottom and support legs, in which the support legs can be released by the tilting bottom.

Furthermore, the fixing points arranged on the inner base of the bottom part guarantee the fastening of lightweight longitudinal webs and their guiding within the cylinder part to connect the bottom part to the head part of the golf bag, and the mounting openings arranged on the jacket surface of the bottom part support the detachable screw connection of the bottom part to the cylinder part.

An arrangement of low-wear off-road wheels with low liability to malfunction is of great advantage. If necessary, the wheels may be fastened to the bottom part by means of a continuous, non-co-rotating axle or floating axles such that their wheel axles extend next to the bottom part in the case of a cylindrical bottom part or are essentially covered and protected by the wheel cases in the case of integrated wheel cases. This offers the advantage that one cannot be caught by the wheels either during rolling or carrying on the shoulder or on the back because they are integrated within the jacket surface of the entire golf bag nearly seamlessly and form a flat unit with the golf bag. Moreover, the eccentric arrangement of the wheel axles relative to the base of the bottom part makes it possible to tilt the golf bag during rolling and to put it down vertically in a stable manner with a three-point bearing despite the tiltability with the base bent in a stepped manner along with the support foot made in one piece with the outer base. Besides the wheels, a beveled base makes possible the arrangement of other, even prior-art support devices with tilting bottom and support legs in which the support legs can be released by the tilting bottom, but this does not guarantee vertical stability.

Also advantageous is the provision of a cylinder part of the golf bag which essentially consists of a flexible material and can be detachably connected to the bottom part and the head part by mounting openings arranged on the open front sides by means of fastening elements such as screws and threaded sleeves, where the cylinder part covers the head part at the same time. The inner outfitting of the cylinder part with coaxial stabilizing strips and loops makes possible the loose guiding of longitudinal webs to stabilize the cylinder part and the distribution of the acting forces during transport of the filled golf bag by the belt among the longitudinal webs. The belt system arranged on the outer jacket surface, which is hung on rings arranged at selectably spaced locations on the cylinder part, on the one hand, and on a toggle lever mechanism arranged at the head part for a support device, on the other hand, makes it possible to carry the golf bag on the shoulder or on the back and to automatically fold in the opened support feet of the support device.

In addition, longitudinal webs which stabilize the cylinder part and essentially consist of a light-weight hollow section, guarantee the lightweight connection of all components of the golf bag from the bottom part to the head part over the cylinder part. One of the longitudinal webs is reinforced by an additional inner tube in order to make allowance for the load requirements imposed by the weight of the golf bag, especially when filled. In addition, the reinforced longitudinal web makes it possible to hold and guide the pull-out grip.

Furthermore, the head part of the golf bag according to the present invention may be a closed material band which is lightweight in itself and is equipped with a mounting surface on its outer jacket surface and with a bracket on the opposite side for the support legs, which are directed toward the bottom part axially to the longitudinal axis of the golf bag. This head part guarantees the connection to the cylinder part and to the bottom part via the stabilizing longitudinal webs, to the pull-out grip and to the support device. The mounting surface and the bracket on the head part make it possible, on the one hand, to arrange the toggle lever mechanism or another mechanism and the clamping system of the support device and its handling as well as of the stabilizing webs. On the other hand, the mounting surface makes possible a stable connection to the reinforced longitudinal web from the bottom part to the head part and the arrangement and the handling of the pull-out grip with the double tube system. The mounting openings present in addition to this on the band material make it possible to cover the head part with the cylinder part and to detachably connect same to the head part by means of fastening elements such as screws or snap fasteners. The essential advantage of this head part design is its high level of functionality in conjunction with a low weight.

The webs arranged horizontally in the head part to stabilize the material band and to protect the clamping system, especially in the case of a load caused by the toggle lever mechanism of the support device, should be pointed out in particular. These webs may be arranged such that they horizontally form a triangular hollow space open on all sides. This hollow space makes it possible to accommodate the clamping system of the support device and ensures its trouble-free function. In addition, the webs, including the clamping system, can be closed by a piece of material such that reaching into the clamping system with the hand or destruction of the clamping system due to the penetration of foreign objects is ruled out.

Additional webs may be arranged in the head part at right angles to the stabilizing webs to form compartments for the separate storage of the golf clubs in the golf bag and support the simple handling of the bag by easy removal or introduction of the golf clubs during the game. In addition, the screws may be used to mount them on the band material of the head part make it possible to accommodate snap fasteners for the detachable fastening of a closing hood after the end of the game.

The functionality of the golf bag according to the present invention is supported especially advantageously by a grip, which may be a pull-out grip. This grip is arranged on the mounting surface of the head part by means of a double tube system and guided on the reinforced longitudinal web such that the grip can be pulled out beyond the center of gravity of the golf clubs being stored in the golf bag during the rolling of the golf bag, as a result of which a considerable reduction in weight is guaranteed for the user. In addition, the double tube system prevents the grip from being pulled completely out of its mount and especially from being jammed during the pushing in of the grip. In addition, the grip holder sloped in relation to the longitudinal axis of the golf bag facilitates handling. The belt system is also advantageous. The optional possibility of fastening to the rings on the cylinder part, which rings are arranged at different distances, on the one hand, and to the toggle lever mechanism of the support device, on the other hand, makes it possible to lift the golf bag with the belt system with the folded-out support feet of the support device folded in automatically at the same time. As a result of this undisturbed carrying of the golf bag on the shoulder or on the back is guaranteed without additional actions on the part of the player.

Finally, the simple lightweight design as well as the materials used and the nondestructively detachable connections between the individual components of the golf bag, as well as the combination of the various possibilities of handling, such as rolling, supporting in a sloped position, standing up vertically and carrying on the back or on the shoulder and easy handling, make possible the easy and compact transport, which may also be versatile as needed, during a change in place as well as during storage and, due to the detachable connections, the repair of the golf bag.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 7 is a side view of the golf bag of FIG. 4 in a sloped position with the grip pulled out and the support legs folded in;

DESCRIPTION OF THE PREFERRED EMBODIMENT

Figure 1:
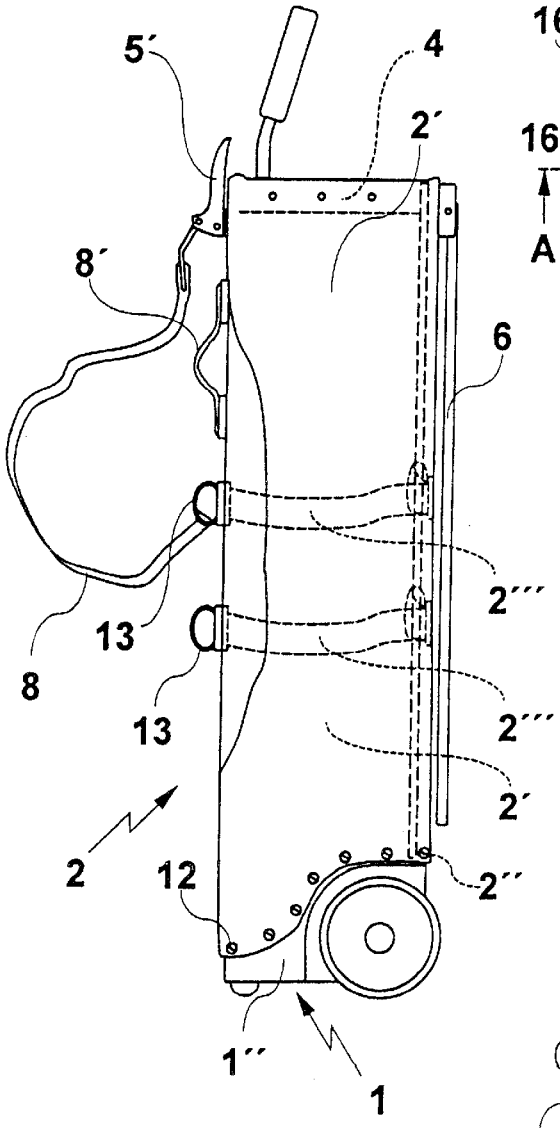
FIG. 1 is a side view of the complete golf bag according to the present invention standing upright.
Figure 2:
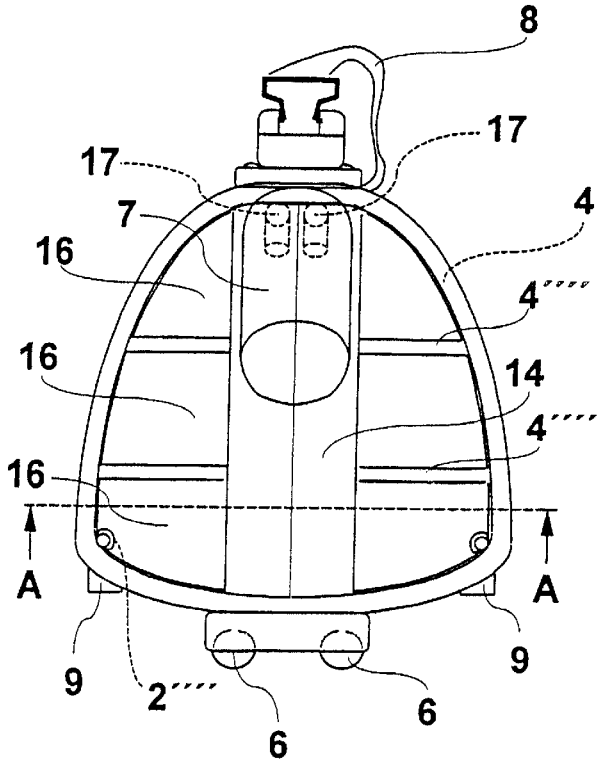
FIG. 2 is a top view of FIG. 1.
Figure 3:
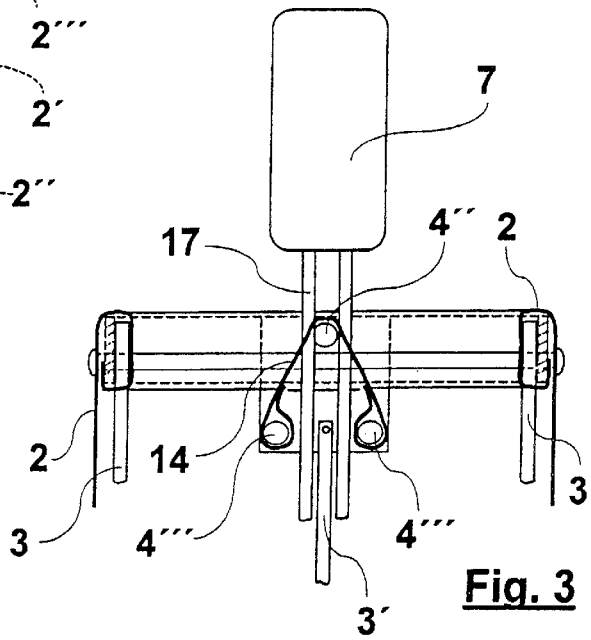
FIG. 3 is sectional view along line A—A from FIG. 2.
Figure 4:
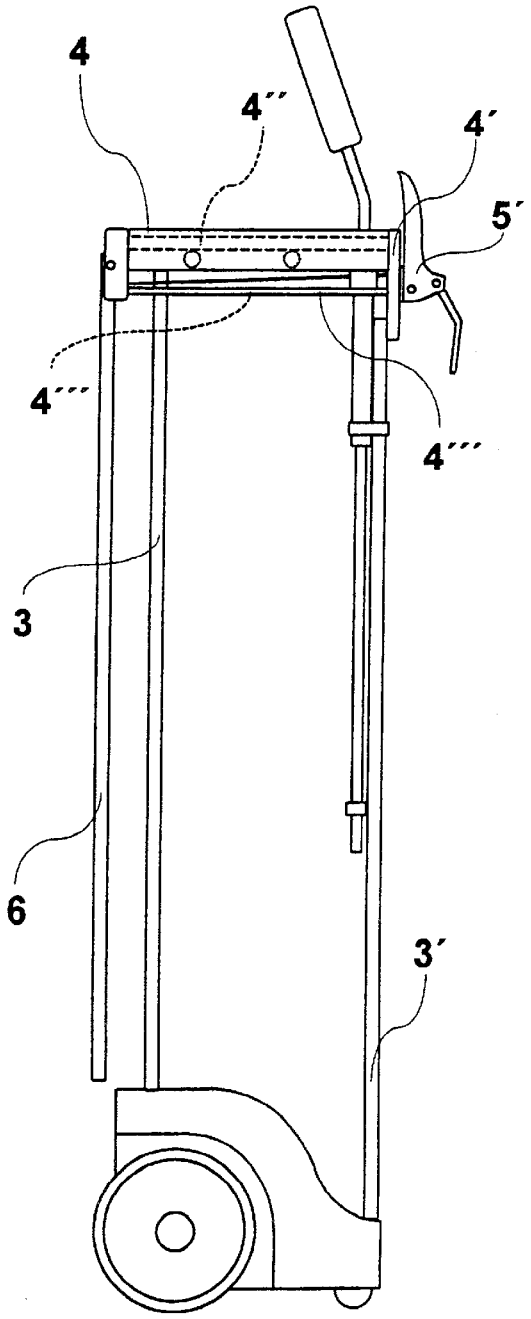
FIG. 4 is a side view of the mounted golf bag frame without cover.
Figure 5:
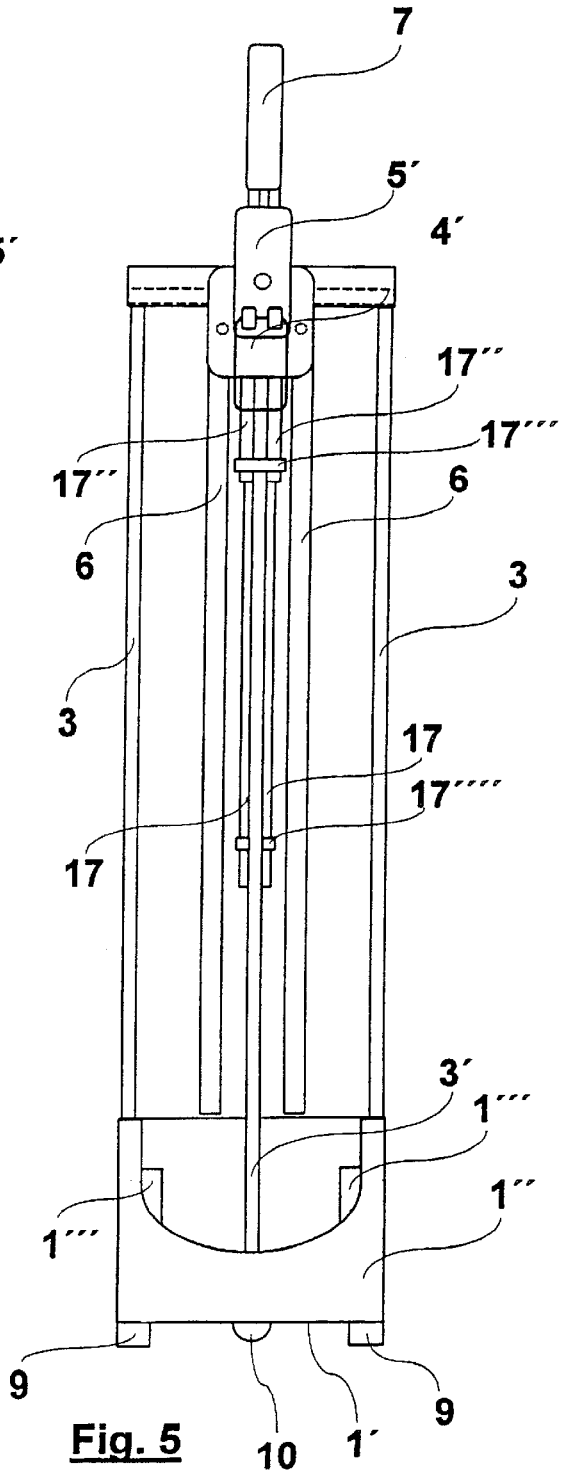
FIG. 5 is a front view of the golf bag of FIG. 4.
Figure 6:
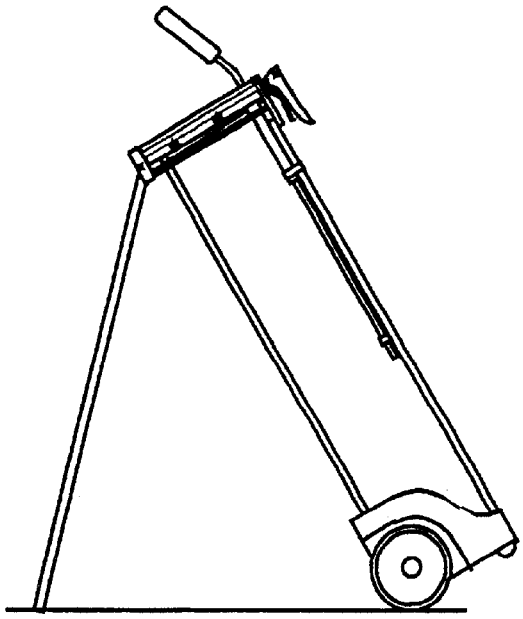
FIG. 6 is a side view of the golf bag of FIG. 4 in a sloped position with the support legs folded out.
Figure 7:
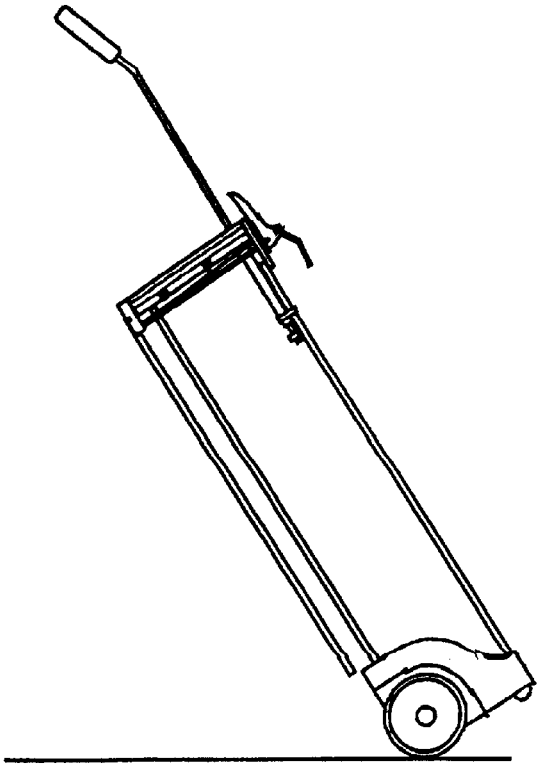
Figure 8:
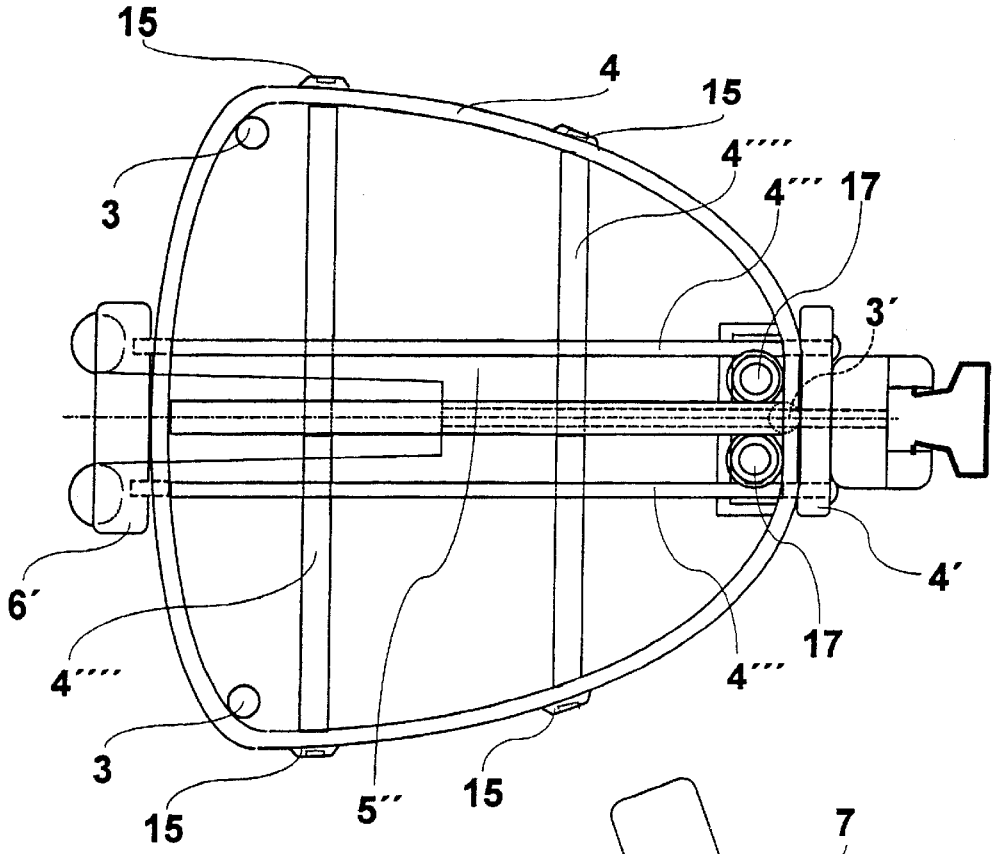
FIG. 8 is a top view of the golf bag of FIG. 4.
Figure 9:
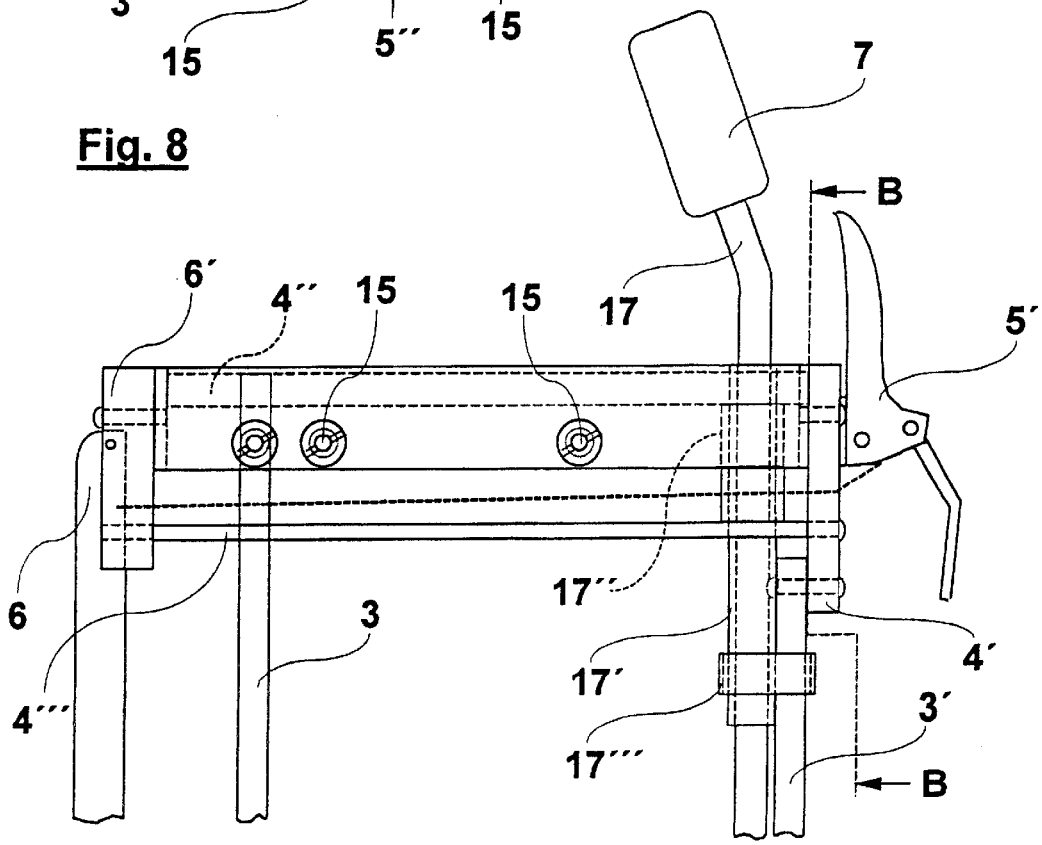
FIG. 9 is a side view of the head part of the golf bag without cover and the grip pushed in and the double tube system for holding same.
Figure 10:
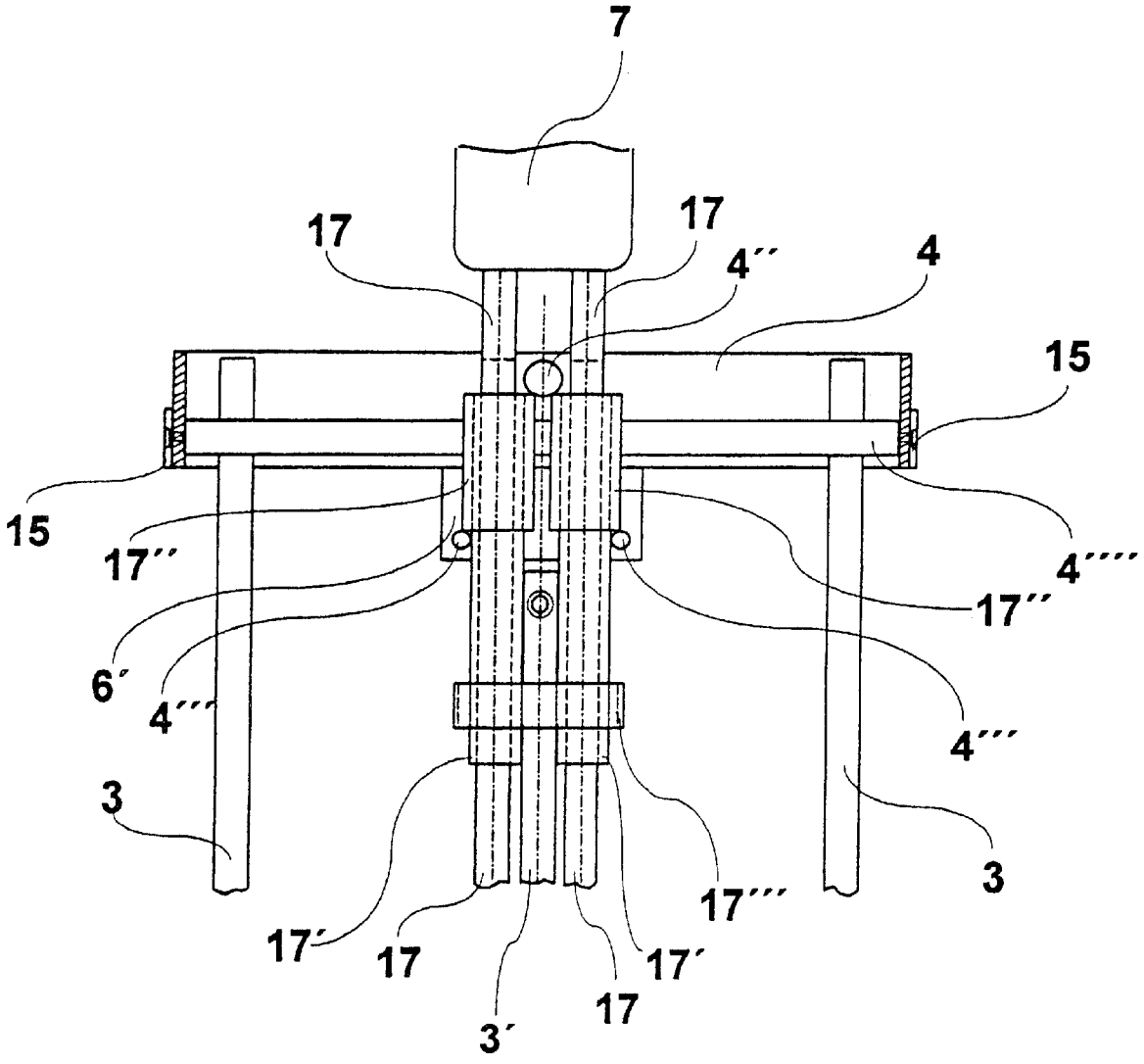
FIG. 10 is a sectional view along line B—B through FIG. 9 with the front view of the double tube system.
Figure 11:
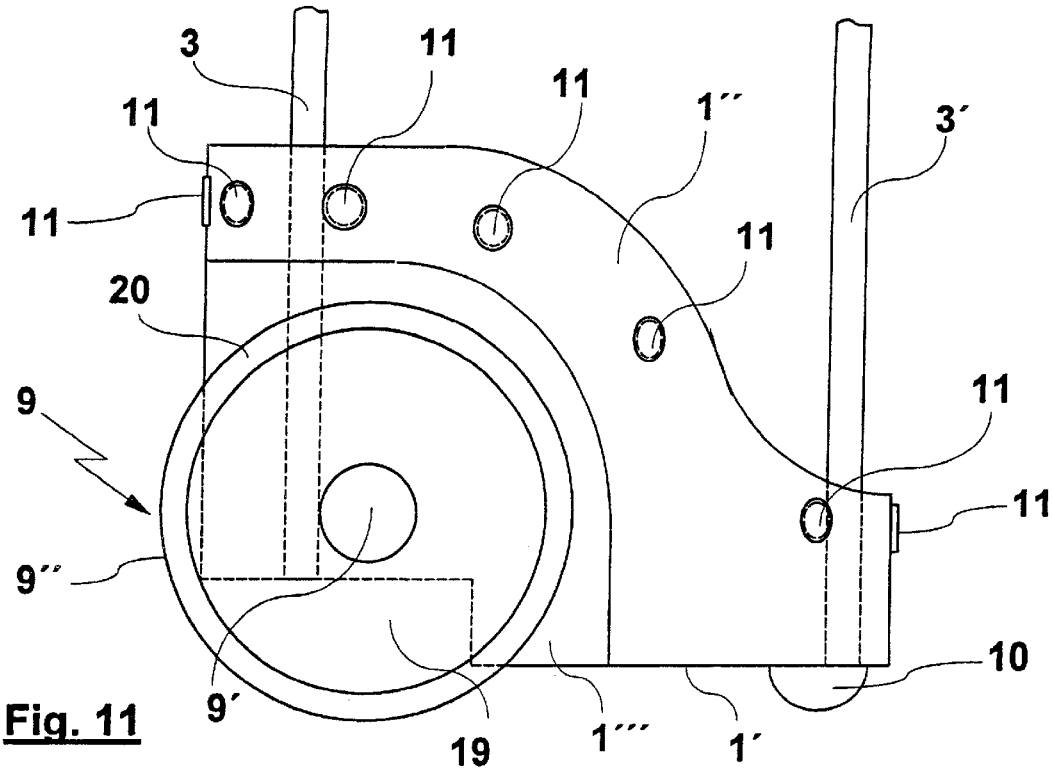
FIG. 11 is a side view of the bottom part of the golf bag with wheels and support foot.
Figure 12:
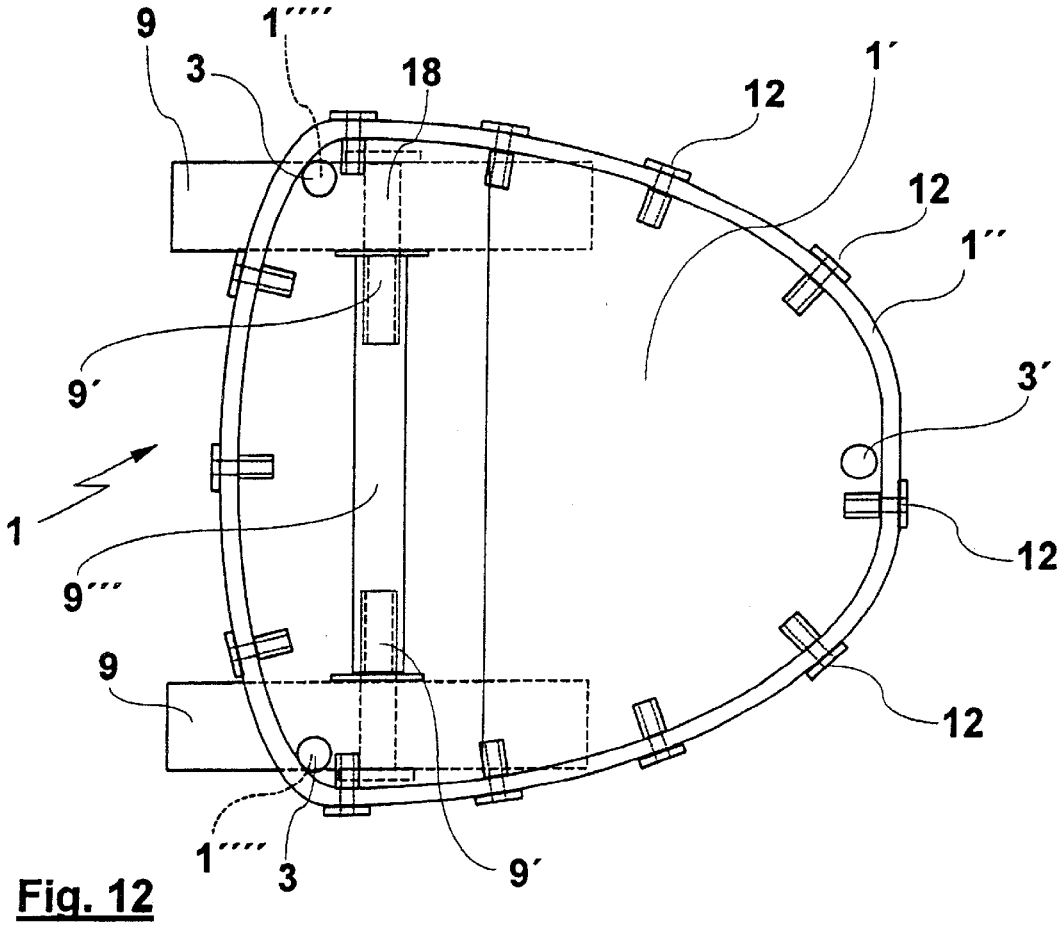
FIG. 12 is a top view of the golf bag of FIG. 11.

Referring to the drawings in particular, the complete golf bag according to the present invention is shown in greater detail in FIG. 1 through FIG. 3 and comprises in this exemplary embodiment a bottom part 1 with wheels 9 and support foot 10, a cylinder part 2 with stabilizing longitudinal webs 3 and 3' as well as a belt system 8, a head part 4 with a mounting surface 4', stabilizing webs 4" and 4'" and webs 4"" as well as a bracket 6' with a support device 5 and support legs 6 as well as a sloped pull-out grip 7. According to FIG. 11 and FIG. 12, the bottom part 1 is preferably an approximately trapezoidal one-piece injection-molded or deep-drawn part manufactured from plastic. The base 1' of the bottom part 1 has dimensions of about 200 mm in length and has a width of 190 mm on one broad side and about 70 mm on the opposite broad side and its vertical jacket surface 1" is made in one piece preferably on the narrow broad side at a level of 50 mm and at a level of 150 mm on the opposite broad side. A wheel case 1'", protruding into the bottom part 1, with the dimensions of, e.g., 120 mm in length, 140 mm in width and 40 mm in depth, is integrated in the oblique areas of the jacket surface 1" of the trapezoidal bottom part 1 which can be recognized in greater detail in FIG. 12. A wheel axle 9' with a diameter of preferably 10 mm of a commercially available wheel 9 with a preferable external diameter of 120 mm passes through the jacket surface 1" of the bottom part 1 at each wheel case 1'" and is mounted there such that the wheel axles 9' do not cross the center of the base 1'. In the exemplary embodiment, the wheel axles 9' are additionally held in a continuous axle sleeve 9'", which does not co-rotate, in order to relieve the jacket surface in the wheel cases 1'". The wheels 9, which preferably have a width of 30 mm, are provided, e.g., with a tread 9" consisting of hard rubber, which has a low degree of wear. The wheel axles 9' are arranged according to FIG. 11 such that the treads 9" of the wheels 9 project beyond the base 1' and beyond the jacket surface 1" on the 190-mm broad side by preferably 15 mm each. Moreover, the wheels 9 are equipped with a ball bearing 18 and thread guard 19, which brings about the good ability of the wheels to run and protects the wheel axles from contamination. The base 1' has, e.g., a step of a height of preferably 10 mm extending vertically to the longitudinal axis of the golf bag in order to guarantee the tiltability of the golf bag and the necessary ground clearance of the bottom part 1. This step is compensated with a support foot 10 made in one piece with the outer base 1' for the good vertical stability of the golf bag. For example, two longitudinal webs 3 and a longitudinal web 3', which are preferably hollow sections made of aluminum, are arranged vertically detachably on the inner base 1' of the bottom part 1 at the fixing points 1"", the longitudinal web 3' being reinforced by an additional inner tube made of carbon. Mounting openings 11, which are preferably provided with threaded sleeves, via which the cylinder part 2 is screwed to the bottom part 1, are arranged at the open edge of the jacket surface 1". The cylinder part 2 is a part made preferably from a stable plastic, which additionally connects the individual components of the frame of the golf bag to one another and covers them according to FIG. 1 On the front sides of its jacket surface 2', it is connected by means of mounting openings 2" to the bottom part 1, on the one hand, and to the head part 4 by fastening elements 12, such as screws, on the other hand. It is, of course, also possible to connect the parts by means of rivets, but this makes it difficult to repair or replace individual parts. The longitudinal webs 3 are guided inside the cylinder part 2 by the loops 2"" of the stabilizing strips 2'" arranged coaxially on the inner jacket surface 2'. The cylinder part 2 is wound around the material band according to FIG. 3 before being fastened to the head part 4 and is fastened with screws, as a result of which the material band of the head part 4 is covered and a load-bearing and stable connection of the cylinder part 2 to the head part 4 is ensured at the same time. Rings 13, which are used to alternatingly receive one end of the belt system 8, are arranged on the stabilizing strips 2'" on the outer jacket surface 2' of the cylinder part 2. In addition, a grip 8' and the rings 13 are arranged such that they extend in the direction of the longitudinal axis of the golf bag above the longitudinal web 3'. Another end of the belt system 8 is preferably fastened to a stable metal loop of a toggle lever mechanism 5' of the support device 5 in order for the support legs 6 to fold in automatically when the golf bag is lifted by the belt system 8. The head part 4 according to the present invention comprises, according to FIGS. 8 through 10, a metal band of a width of preferably 30 mm and preferably has, according to FIG. 8, like the bottom part 1, an approximately trapezoidal shape. A mounting surface 4' made preferably of plastic, which extends axially in relation to the longitudinal axis and in the direction of the bottom part 1 of the golf bag, is screwed to the narrow outer surface of the metal band. A bracket 6' for the support feet 6 is screwed on on the opposite side on the broad side of the metal band. A web 4" consisting of a hollow section is screwed on centrally between the mounting surface 4' and the bracket 6' on both sides on the front side of the metal band, which front side is used as the opening of the golf bag, to stabilize the metal band and consequently the head part 4. According to FIG. 9, two additional webs 4'" consisting of a hollow section are screwed to the lower edge of the mounting surface 4', on the one hand, and to the bracket 6' of the support legs 6, on the other hand, under and on both sides of the web 4". According to FIG. 2, the webs 4'" form with the web 4" a hollow space open on all sides, in which the clamping system 5" of the support device 5, not shown in detail, extends. As is shown more specifically in FIG. 2, the webs 4" and 4'" as well as the clamping system 5" are closed and covered with a piece of material 14 preferably consisting of leather, with two opposite edges of the piece of material 14 being wound around the webs 4'" and are detachably fastened by means of, e.g., a VELCRO strip (hook and loop fastener strip). The webs 4"" screwed to the metal band of the head part 4 at right angles to the webs 4" and 4'" are likewise hollow sections to form compartments 16, on the one hand, and are screwed on with screws 15 to additionally stabilize the material band of the head part 4, on the other hand. For example, screws whose heads form the base part of a snap fastener were selected for this purpose in order to button to these, e.g., a cover hood, with which the golf bag with the golf clubs protruding from it can be closed after the end of the game. The support legs 6 are arranged movably on the bracket 6' and are connected to the toggle lever mechanism 5' arranged on the outer mounting surface via the clamping system 5". According to FIG. 10, the free ends of the longitudinal webs 3 are screwed to the metal band of the head part 4, the longitudinal web 3' is made somewhat shorter because of limited space and is connected to the mounting surface 4'. FIG. 8, FIG. 9 and FIG. 10 show the arrangement of the grip 7 with its double tube system in greater detail. According to FIG. 10, the grip 7 is arranged on the inside of the mounting surface 4', and the two tubes 17 of the grip 7 are mounted movably in a sleeve 17' each, and the sleeves 17' are held in a sleeve 17" each between the webs 4'" and 4". A fixer 17'" each, with which the ends of the sleeves 17' are locked at the longitudinal web 3', is arranged at the ends of the sleeves 17'. The ends of the tubes 17 are guided vertically movably at the longitudinal web 3' by a guide strap 17"". At its end protruding from the golf bag, the grip 7 is preferably sloped by about 20% in relation to the longitudinal axis of the golf bag in order to thus guarantee better handling. FIG. 4 and FIG. 5 show a completely mounted frame of the golf bag, without the cylinder 2, i.e., without cover, for the sake of greater clarity, with the support legs 6 folded in. FIG. 6 shows the frame in a sloped position with the support legs 6 folded out and the grip 7 pushed in. FIG. 7 shows the golf bag in the rolling position with the grip 7 pulled out and the support legs 6 folded in. Finally, the golf bag according to the present invention may also be equipped only with a support system 5 and without rollable bottom part 1 in a second variant or, in a third variant, with rollable bottom part 1 and without support system 5. The use of various materials is, of course, also variable. Thus, the cylinder part may also consist of leather or nylon or another sturdy fabric.

While specific embodiments of the invention have been shown and described in detail to illustrate the application of the principles of the invention, it will be understood that the invention may be embodied otherwise without departing from such principles.

What is claimed is:

1. A golf bag comprising:

a cylinder part with stabilizing longitudinal rods, one of said longitudinal rods being a reinforced longitudinal rod;

a head part connected to said cylinder part in a repeatedly detachable manner, support legs connected to said head part;

a bottom part connected in a repeatedly detachable manner to said cylinder and rollable in a travel direction, said head part and said bottom part being connected to said longitudinal rods to form a frame, said cylinder being arranged around said frame, said bottom part including integrated wheels and a rest support, said wheels, said rest support, and said legs arranging the golf bag titlably, displaceably and in a stable position in a vertical direction; a support device with a toggle lever mechanism and a clamping system for folding out and folding in said support legs, said support device being connected to said head part;

a pull-out grip connected to said head part;

a belt system connected to said cylinder part and said support device, said belt system moving said legs between a folded in position and said sloped position, said belt system with said support device supporting the golf bag with said legs in said folded in position on a back of a user.

2. A golf bag in accordance with claim 1, wherein said bottom part is a light-weight, dimensionally stable, one-piece container with a base bent in a stepped pattern and with a fastening surface made in one piece with it vertically, said fastening surface having different heights in the vertical direction in relation to said base, said rest support, which makes possible stable vertical standing of the golf bag, is arranged at an outer portion of said base;

said fastening surface is provided with two integrated wheel cases, which are directed into said bottom part and a wheel bearing each is arranged opposite each other in said two wheel cases and a plurality of mounting openings are arranged at an upper edge of said fastening surface, and at least three fixing points are ranged ax an inner portion of said base.

3. A golf bag in accordance with claim 2, wherein:

said wheels have wheel axles passing through said vertical fastening surface in an area of said wheel cases, wherein said wheel axles do not cross a center of said inner portion of said base, and said wheels are essentially covered and protected by said wheel cases;

bases of said wheels project beyond said base toward the ground and beyond said fastening surface in the direction of travel, wherein said bases and said rest support make possible the stable vertical standing of the golf bag.

4. A golf bag in accordance with claim 2, wherein: said stabilizing longitudinal rods each include a lightweight hollow section and are connected to said fixing points of said inner portion of said base of said bottom part with one end and to said head part with another end, said reinforced longitudinal rod is reinforced by an additional inner tube and is connected on a wheel side of the golf bag to one of said fixing points of said inner portion of said base of said bottom part, another end of said reinforced longitudinal rod is connected to said head part via a mounting surface.

5. A golf bag in accordance with claim 1, wherein: said cylinder part is formed of a flexible and stable material and is equipped at upper and lower edges with a plurality of mounting openings, which are connected via fastening elements to a fastening surface of said bottom part and to said head part in a repeatedly detachable manner; a plurality of stabilizing strips made of a flexible material are arranged coaxially at an inner surface of said cylinder part; said belt system and a belt grip are arranged at an outer surface of said cylinder part extending axially along said reinforced longitudinal rod, rings are arranged at said stabilizing strips.

6. A golf bag in accordance with claim 1, wherein: said head part is a closed band material; a mounting surface is arranged at said head part, a bracket is arranged opposite said mounting surface; a front surface of said head part is stabilized by a first longitudinal strut and by two additional longitudinal struts arranged in a vertically offset pattern, which are fastened with one end to said mounting surface and with another end to said bracket, wherein all said longitudinal struts form a horizontally extending triangular hollow space.

7. A golf bag in accordance with claim 6, wherein: said toggle lever mechanism is arranged at said mounting surface; said support device with said support legs is arranged at said bracket; said toggle lever mechanism and said support device are connected to one another movably via said clamping system; said clamping system is mounted in said triangular hollow space formed by said stabilizing longitudinal struts, wherein said movable clamping system and said longitudinal struts are surrounded and covered by a piece of flexible material to prevent injury to the bands of the user.

8. A golf bag in accordance with claim 6, wherein: at least two crosswise struts, extend in parallel to one another and are each detachably connected to the said head part by of screws, are arranged in said head part at right angles to said longitudinal struts, wherein said longitudinal struts and said crosswise struts subdivide said head part into a plurality of head openings, and heads of said screws are designed as a base part of a snap fastener.

9. A golf bag in accordance with claim 6, wherein said pull-out grip comprises a double tube system, in which two said tubes are arranged in parallel in a grip part and are sloped to the longitudinal axis of the golf bag at the end of the grip; tube ends, which protrude from the grip part, are guided in a sleeve each at said reinforced longitudinal rod on a belt side of the golf bag and held by sleeves, a fixer and a guide strap, which are held vertically between said longitudinal struts in said head part; and said grip can be pulled out in a direction of a longitudinal axis of the golf bag to the extent that said grip projects over heads of golf clubs arranged in the golf bag.

10. A golf bag in accordance with claim 1, wherein: said belt system is connected at one end to said toggle lever mechanism and to said clamping system of the said support device, and said belt system is also connected at another end to one of a plurality of rings on said cylinder part, wherein said support legs of said support device fold out by putting down the golf bag with said belt system and said support legs fold in by lifting the golf bag by said belt system.

11. A golf bag comprising:

a bottom part;

a plurality of longitudinal rods extending from said bottom part;

a head part connected to said plurality of longitudinal rods, said head part being spaced from said bottom part, said plurality of longitudinal rods, said bottom part and said head part being arranged to form a frame; said head part is a closed band material, on an outside of said closed band material a mounting surface and a bracket are arranged opposite each other and are directed axially to said bottom part;

a cylinder connected to said bottom part and said top part;

two wheels connected to said bottom part and arranged to roll the golf bag in a travel direction;

a plurality of support legs pivotally connected to said head part, said plurality of support legs and said plurality of wheels being ranged on a same side of the golf bag said two wheels and said plurality of legs being arranged to support the golf bag in a tilted position toward said travel direction;

a grip arranged inside said cylinder and movable into and out of said cylinder through said head part, said grip being arranged on a side of the golf bag diametrically opposite said plurality of wheels and said plurality of legs;

a belt system connected to said head part on said side of the golf bag diametrically opposite said plurality of wheels and said plurality of legs;

a clamping system connecting said belt system to said plurality of legs to pivot said plurality of legs between a first and a second position when said belt system supports the golf bag;

a strut and two additional struts are arranged at said inner mounting surface and at said bracket of said head part to stabilize an open front surface of said head part, wherein said strut and said additional struts form a triangular hollow space open on all sides;

two cross struts are detachably connected to said head part by screws on both sides and are arranged at right angles to said strut and said additional struts, wherein said cross struts form compartments for golf clubs, said screws having heads forming base parts of snap fasteners.

12. A golf bag comprising:

a bottom part;

a plurality of longitudinal rods extending from said bottom part;

a head part connected to said plurality of longitudinal rods, said head part being spaced from said bottom part, said plurality of longitudinal rods, said bottom part and said head part being arranged to form a frame;

a cylinder connected to said bottom part and said top part;

two wheels connected to said bottom part and arranged to roll the golf bag in a travel direction;

a plurality of support legs pivotally connected to said head part, said plurality of support legs and said plurality of wheels being arranged on a same side of the golf bag, said two wheels and said plurality of legs being arranged to support the golf bag in a tilted position toward said travel direction;

a grip arranged inside said cylinder and movable into and out of said cylinder through said head part, said grip being arranged on a side of the golf bag diametrically opposite said plurality of wheels and said plurality of legs;

a belt system connected to said head part on said side of the golf bag diametrically opposite said plurality of wheels and said plurality of legs;

a clamping system connecting said belt system to said plurality of legs to pivot said plurality of legs between a first and a second position when said belt system supports the golf bag.

13. An golf bag in accordance with claim 12, wherein:

said bottom part defines a plurality of recesses;

said two wheels are arranged in said plurality of recesses.

14. An golf bag in accordance with claim 12, wherein:

said clamping system extends through said head part from said belt system to said plurality of legs.

15. An golf bag in accordance with claim 14, wherein:

said head part includes a plurality of stabilizing struts extending across said head part and around said clamping system.

* * * * *